US010525365B2

(12) United States Patent
Muraki et al.

(10) Patent No.: US 10,525,365 B2
(45) Date of Patent: Jan. 7, 2020

(54) SPINNING TOP TOY

(71) Applicant: TOMY Company, Ltd., Tokyo (JP)

(72) Inventors: Makoto Muraki, Tokyo (JP); Takeaki Maeda, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 16/281,791

(22) Filed: Feb. 21, 2019

(65) Prior Publication Data

US 2019/0255450 A1 Aug. 22, 2019

(30) Foreign Application Priority Data

Feb. 22, 2018 (JP) ..... 2018-029451

(51) Int. Cl.

*A63H 1/00* (2019.01)
*A63B 67/12* (2006.01)
*A63H 1/04* (2006.01)

(52) U.S. Cl.

CPC ..... *A63H 1/00* (2013.01); *A63B 67/12* (2013.01)

(58) Field of Classification Search

CPC ... A63H 1/00; A63H 1/02; A63H 1/04; A63H 1/18; A63F 9/00; A63F 9/16

USPC ..... 446/256–264

See application file for complete search history.

(56) References Cited

U.S. PATENT DOCUMENTS

2011/0256796 A1* 10/2011 Ujita ..... A63H 1/00 446/264
2014/0302743 A1* 10/2014 Cai ..... A63H 1/18 446/256

FOREIGN PATENT DOCUMENTS

JP 6258541 B1 1/2018

* cited by examiner

*Primary Examiner* — Kien T Nguyen

(74) *Attorney, Agent, or Firm* — IP Business Solutions, LLC

(57) ABSTRACT

A spinning top toy used for battle games in which the spinning top toy collides with an opponent spinning top toy includes a shaft part, a body, and first and second gripping members. The body is configured on the shaft part. The first and second gripping members are configured on at least a part of an outer periphery of the body. One of the first and second gripping members is urged to the other of the first and second gripping members to have a first distance therebetween. The first and second gripping members are separated to have a second distance therebetween when the shaft part is rotated. The first distance is smaller than the second distance.

9 Claims, 8 Drawing Sheets

SPINNING TOP TOY

CROSS-REFERENCE TO THE RELATED APPLICATION

The present application claims priority under 35 U.S.C. 119 to Japanese Patent Application No. 2018-029451 filed on Feb. 22, 2018. The entire content of Japanese Patent Application No. 2018-029451 is incorporated herein by reference.

BACKGROUND

Filed of the Invention

The present invention relates to a spinning top toy

Description of Related Art

As battle games using spinning top toys, by applying impact to the spinning top toys each other, there are cases in which the rotation of opponent's spinning top toy is stopped by the impact force, opponent's spinning top toy is flicked out by the impact force, or opponent's spinning top toy is disassembled by the impact force, etc.

In such spinning top toys for battle games, a part colliding with the opponent, that is, a blade (attacking member) is formed on a circumference surface of a body, so that the blade is collided. Further, it is well known that a projecting amount of the blade with respect to the body main part is changed in response to the rotation position of the body main part with respect to the shaft part of the spinning top toy (see e.g., Patent Document 1).

[Patent Document 1] Japanese Patent No. 6258541

SUMMARY

However, in this kind of the spinning top toys, basically, while being fallen down or being disassembled, the spinning top toys were repeatedly collided and flicked out each other, so that it was lack of unexpectedness, and the game development was not largely changed.

The present invention was conceived in considering the aforementioned problems. An object is to provide a spinning top toy which has unexpectedness and can largely change a game development.

In view of the above problems, a spinning top toy used for battle games in which the spinning top toy collides with an opponent spinning top toy includes a shaft part, a body, and first and second gripping members. The body is configured on the shaft part. The first and second gripping members are configured on at least a part of an outer periphery of the body. One of the first and second gripping members is urged to the other of the first and second gripping members to have a first distance therebetween. The first and second gripping members are separated to have a second distance therebetween when the shaft part is rotated. The first distance is smaller than the second distance.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims. In the drawings, the size and relative sizes of layers and regions may be exaggerated for clarity. Like numbers refer to like elements throughout. The terminology used herein is for the purpose of describing particular embodiments only and is not intended to be limiting of the invention. As used herein, the singular forms "a", "an" and "the" are intended to include the plural forms as well, unless the context clearly indicates otherwise. As used herein, the term "and/or" includes any and all combinations of one or more of the associated listed items and may be abbreviated as "/". It will be understood that, although the terms first, second, etc. may be used herein to describe various elements, these elements should not be limited by these terms. Unless indicated otherwise, these terms are only used to distinguish one element from another. For example, a first object could be termed a second object, and, similarly, a second object could be termed a first object without departing from the teachings of the disclosure. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. It will be understood that when an element is referred to as being "connected" or "coupled" to or "on" another element, it can be directly connected or coupled to or on the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.). However, the term "contact," as used herein refers to direct contact (i.e., touching) unless the context indicates otherwise. Terms such as "same," "planar," or "coplanar," as used herein when referring to orientation, layout, location, shapes, sizes, amounts, or other measures do not necessarily mean an exactly identical orientation, layout, location, shape, size, amount, or other measure, but are intended to encompass nearly identical orientation, layout, location, shapes, sizes, amounts, or other measures within acceptable variations that may occur, for example, due to manufacturing processes. The term "substantially" may be used herein to reflect this meaning. Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

DETAILED DESCRIPTION OF THE PREFERRED EMBODIMENTS

Figure 1:
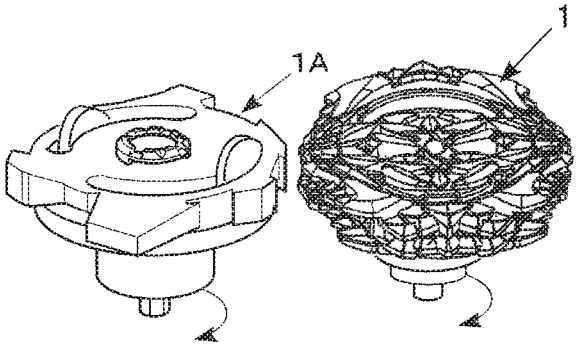
FIG. 1 is a perspective view showing a situation of a battle game by using a spinning top toy according to an embodiment.

Hereinafter, a spinning top toy of the present invention will be described based on embodiments shown in the drawings.

Whole Structure

Figure 2:
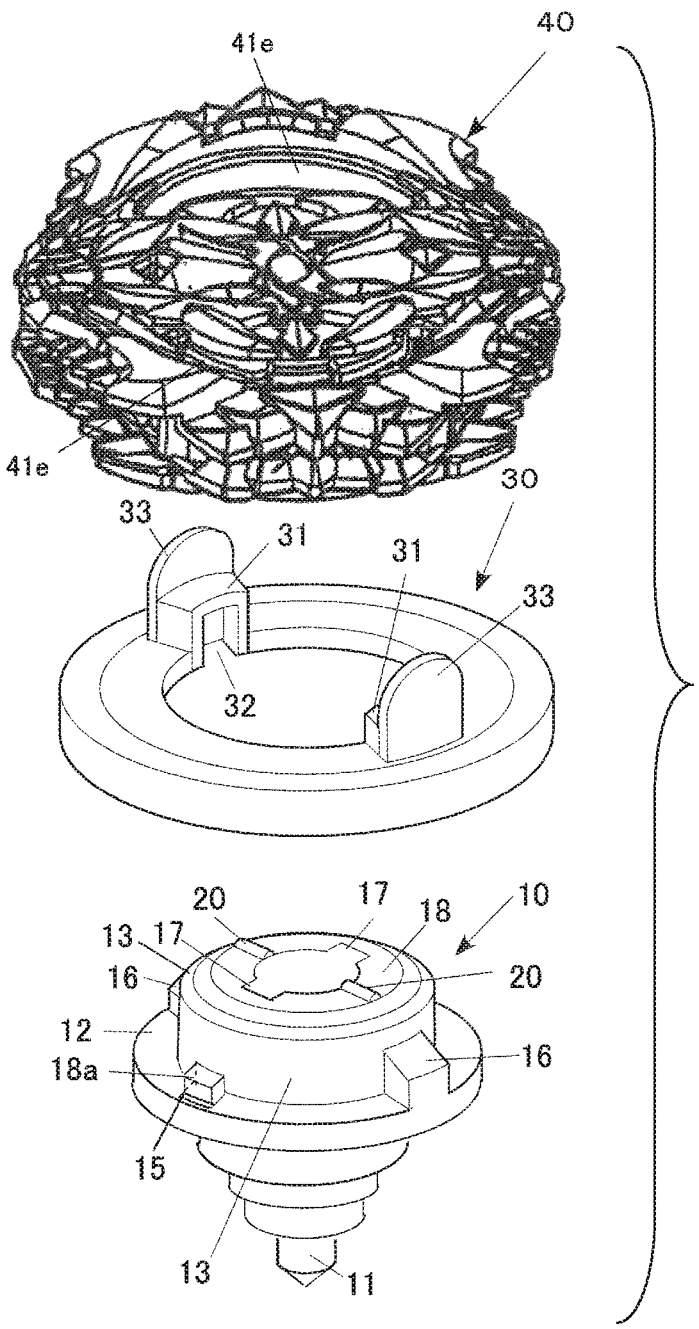
FIG. 2 is an exploded perspective view of the spinning top toy.

FIG. 1 is a perspective view showing a situation of one example of battle games performed by using a spinning top toy according to an embodiment. The battle games are intended to fight by colliding spinning top toys each other. FIG. 2 is an exploded perspective view of the spinning top toy 1 according to an embodiment which is used for the battle games. The spinning top toy 1 is provided with a shaft part 10, a flywheel 30, and a body 40.

Detail of the Structure

1. Shaft Part 10 and Flywheel 30

Figure 3:
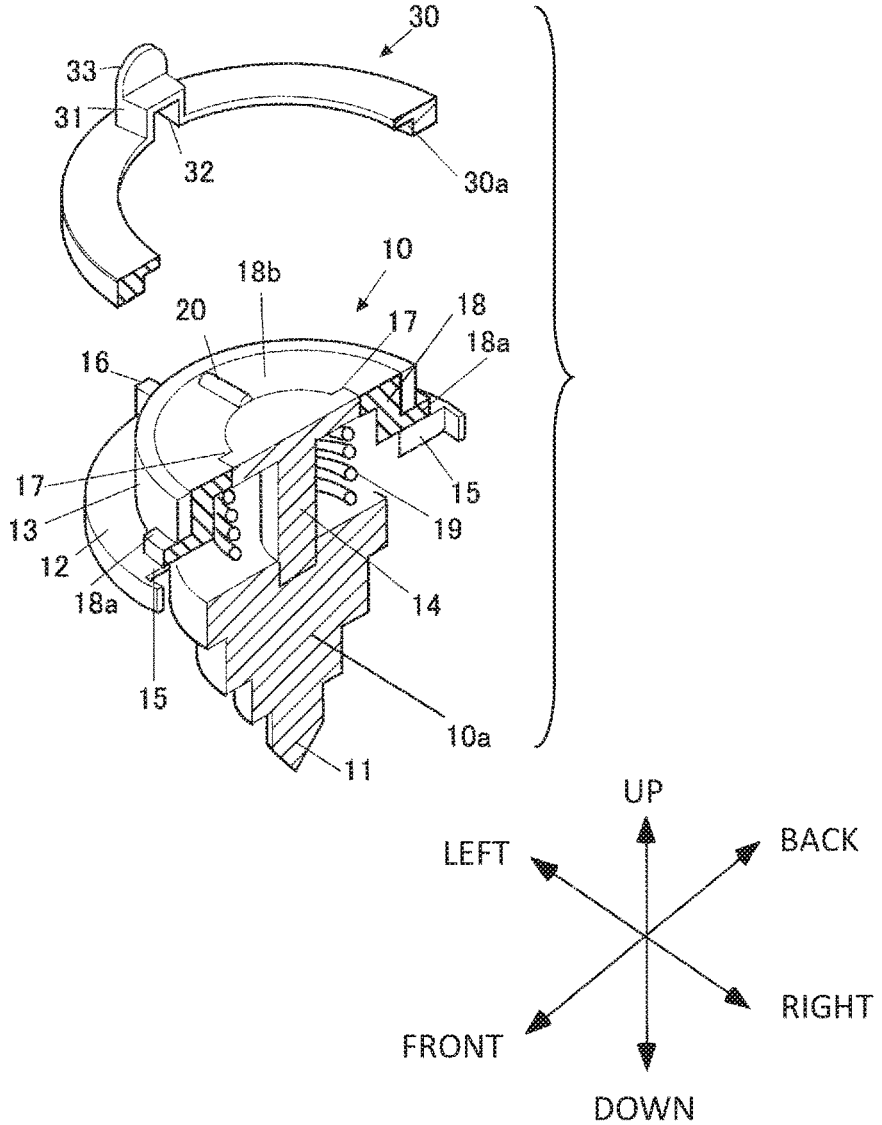
FIG. 3 is a vertical cross-sectional perspective view showing a half of a shaft part and a flywheel of the spinning top toy.

FIG. 3 is a perspective view showing a half part of the shaft part 10 and the flywheel 30. The remaining half part with respect to the half part is point symmetry. In the explanation of the shaft part 10, the terms "up", "down", "left", "right", "front", and "back" refer to the corresponding directions in FIG. 4.

Among the parts, the shaft part 10 is provided with a rotating shaft 11, which is a grounding part and positioned at a lower end part, a flange 12 which is an intermediate part in the vertical direction, and a cylindrical body 13 which is positioned in an upper end part.

The flange 12 and the cylindrical part 13 are integrally formed. A cylinder 14 is provided in the shaft center of the cylindrical body 13. The upper end part of the cylinder 14 is a ceiling wall, and an overhanging hook 17 projects outwardly in a radial direction in each of the front and back in the outer periphery of the ceiling wall 14*a*. The cylinder 14 is fixedly provided in a shaft lower part 10*a*. The outer periphery surface of the shaft lower part 10*a* is gradually reduced in diameter in the direction from the flange 12 side to the tip end side of the rotating shaft 11, so as to form an approximately reversed conical shape as a whole. The shaft lower part 10*a* is fastened to the flange 12 by a screw, etc. which is not shown in the drawings.

In each of the front and back of the flange 12 and the cylindrical body 13, a hole 15 is formed throughout the flange 12 and the cylindrical body 13. Further, in each of the right and left of the outer periphery surface of the cylindrical body 13, a projection part 16 is formed. The outer surface of each projection part 16 is flush with the outer periphery surface of the flange 12.

Further, the shaft part 10 is provided with a cylindrically shaped urging member 18. The urging member 18 has an annular top plate 18*b* which is the shape fitting to the outside of the upper end part of the cylinder 14, and the inner part is hollow and opening downwardly. The urging member 18 is arranged inside cylindrical body 13 in a manner of surrounding the cylinder 14. In each of the front and back of the outer periphery of the lower end part of the urging member 18, a leg part 18*a* is formed and stretches outwardly in a radial direction.

The urging member 18 is installed so as to expose leg parts 18*a* from the holes 15 which correspond to the leg parts 18*a*. The holes 15 allow the movement of the leg parts 18*a* in the vertical direction, but the movement is restricted at the upper edge of the holes 15. Further, the urging member 18 is urged in the upper direction by the spring 19.

In each of the right and left of the upper surface of the urging member 18, a protruding strip (projection) 20 extending in a radial direction is formed.

2. Flywheel 30

The flywheel 30 is annularly formed. At the inner periphery side of the bottom surface of the flywheel 30, an annular step part 30*a*, which can store the flange 12 of the shaft part 10 from the lower side, is formed. A projection part 31, which projects toward the upper side, is formed in each of the right and left of the upper surface of the flywheel 30. At the lower side part of each projection part 31, a recessed part 32, which can store the projection part 16 of the shaft part 10 from the lower side, is formed. Further, on the upper surface of the flywheel 30, a tongue-piece part 33, which extends upwardly, is formed directly outside of each of the projection parts 31. The tongue-piece parts 33 project higher than the projection parts 31.

3. Body 40

Figure 4:
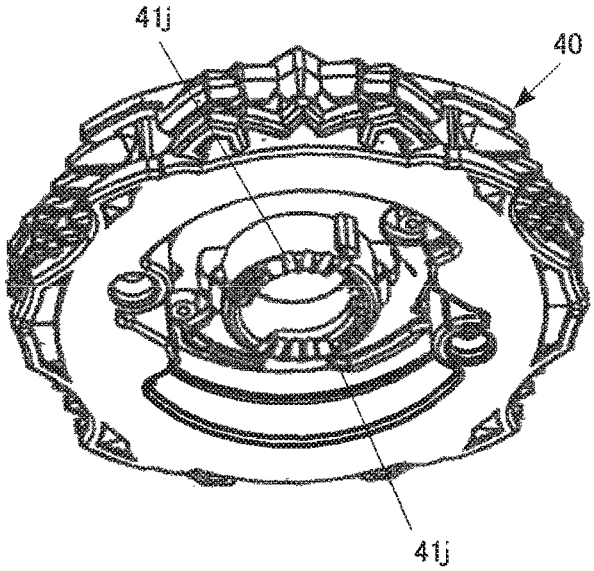
FIG. 4 is a perspective view showing a body of the spinning top toy when viewed from the lower side.

FIG. 4 is a perspective view showing a state in which the body 40 of the spinning top toy 1 is viewed from the lower side.

Figure 5:
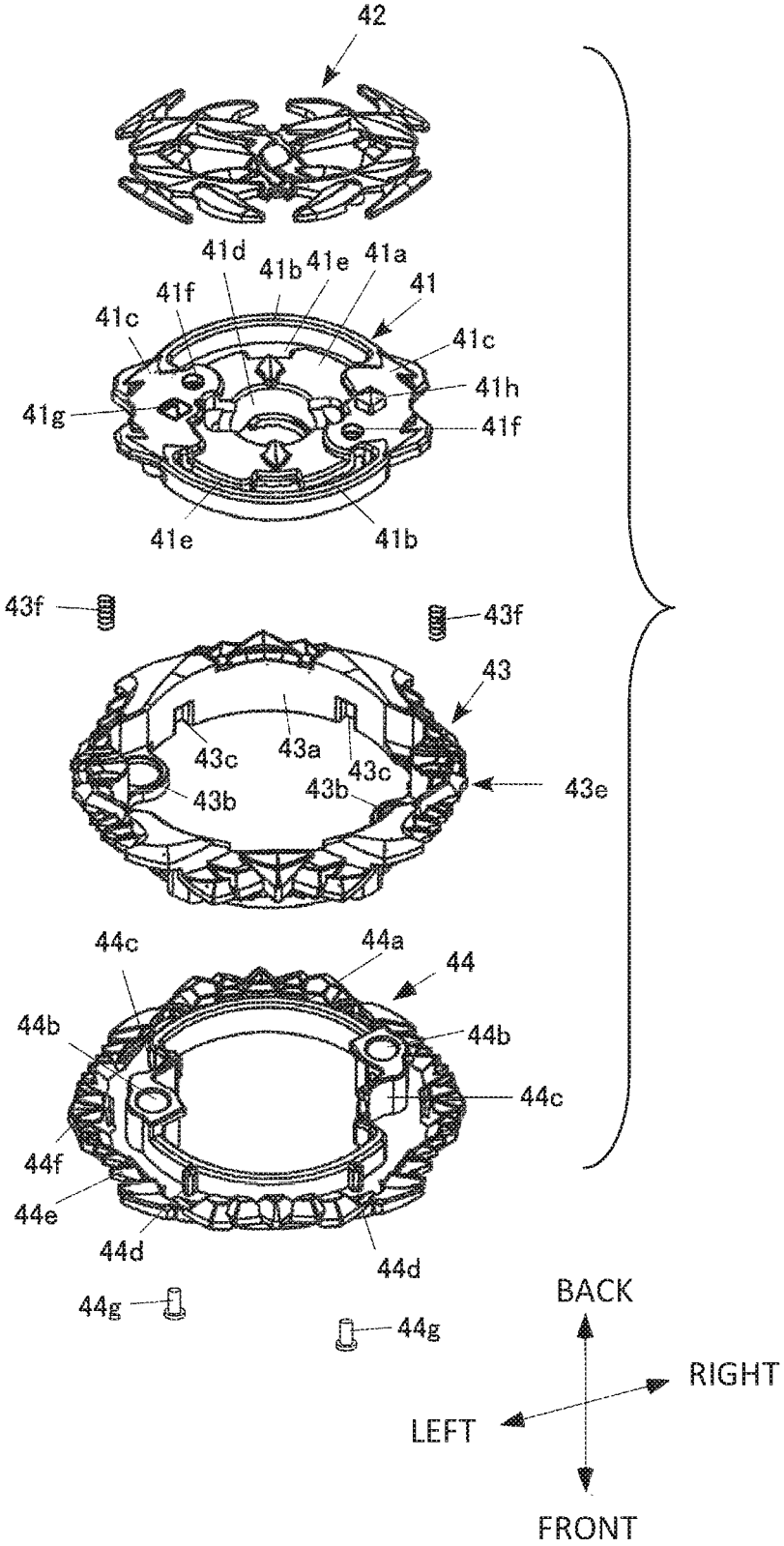
FIG. 5 is an exploded perspective view showing the body of the spinning top toy when viewed from the upper side.

The body 40 has a disk-shape as a whole. As shown in FIG. 5, the body 40 is provided with a body base 41, an upper surface cover 42, an upper side gripping member 43, and a lower side gripping member 44. In the explanation of the body 40, the terms "left", "right", "front", and "back" refer to the corresponding directions in FIG. 5.

As shown in FIG. 5, on the upper surface of the body base 41, a recessed part 41*a* is formed. The recessed part 41*a* is divided by two edge walls 41*b*, 41*b*, which are faced each other across the shaft center in the front and back direction and are raised, and two elevations 41*c*, 41*c* which are faced each other across the shaft center in the right and left direction. In the center of the recessed part 41*c*, a circular hole 41*d* is formed. In the recessed part 41*a*, one arcuate slit 41*e* is formed inside each edge wall 41*b*. In each elevation 41*c*, one inserting hole 41*f* is formed. Further, in one of the elevations 41*c*, a hole 41*g* is formed, and in the other one of the elevations 41*c*, a projection 41*h* is formed.

Figure 6:
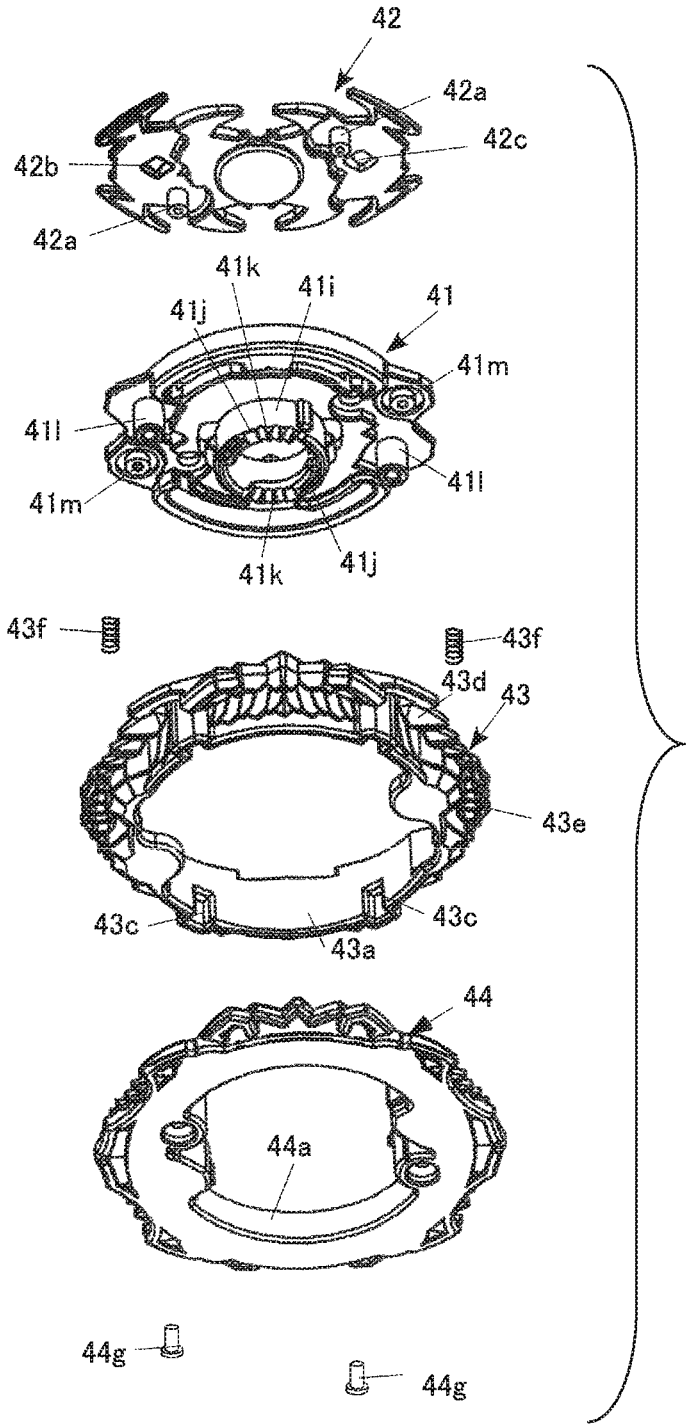
FIG. 6 is an exploded perspective view showing the body of the spinning top toy when viewed from the lower side.

As shown in FIG. 6, on the lower surface of the body base 41, a cylindrical wall 41*i* is formed and extends to a lower end thereof, to which the edge of the hole 41*d* extends downwardly. In the lower end inner periphery of the cylindrical wall 41*i*, in each of two places which are faced each other across the shaft center, one hook 41*j* is formed. In the lower surface of each hook 41*j*, in the one end part of the circumferential direction, a raised part 41*k*, in which a plurality of protruding strips extending in the radial direction is formed in a predetermined interval in the circumferential direction, is formed.

Further, in the lower surface of the body base 41, in a position which is the lower side of each elevation 41*c*, one columnar shaped female screw part 41*l* and one spring hook part 41*m* are formed.

A upper surface cover 42 is assembled on the top of the body base 41.

As shown in FIG. 6, on the lower surface of the upper surface cover 42, a columnar part 42*a* is formed in a place corresponding to each inserting hole 41*f* of the aforementioned body base 41. Further, on the lower surface of the upper surface cover 42, a hole 42*b* is formed in a place corresponding to the hole 41*g* of the aforementioned body base 41, and a hole 42*c* is formed in a place corresponding to the projection 41*h* of the aforementioned body base 41.

The upper surface cover 42 is made of metal, and the projection 41*h* is fitted to the hole 42*c*. In the state in which each columnar part 42*a* is fitted to each inserting hole 41*f*, the upper surface cover 42 is swaged, so as to be assembled to the body base 41. Accordingly, the upper surface cover 42 covers the body base 41 except the places of the two slits 41*e*, 41*e*.

The lower side gripping member 44 is assembled to the lower side of the body base 41.

The lower side gripping member 44 is configured by a ring member. On the upper surface of the lower side gripping member 44, an edge wall 44*a*, which is raised along all of the inner periphery edge, is formed. In the edge wall 44*a*, in each of two places faced each other across the shaft center in the right and left direction, one inserting hole 44*b* is formed. In the place positioned adjacent to each inserting hole 44*b* in the plane view, the edge wall 44*a* becomes a recessed part 44*c* which is recessed toward the inner periphery. Two guide projections 44*d* are provided in each of the front and back of the outside of the edge wall 44*a*.

The outer periphery part of the lower side gripping member 44 is formed by a small blade 44*e* having various tip shapes. The top surface of the small blade 44*e* is formed in an angular shape or a flat shape, and by the top surface of the small blade 44*e*, the gripping part 44*f* configured with small protrusions and recesses is formed. The gripping part 44*f* is curved in a sine wave shape with respect to the horizontal plane as a whole. By the way, instead of being provided with simply only the protrusions and recesses, the gripping surface of the gripping part 44*f* may be formed by a rubber, which has a large friction resistance, with protrusions and recesses.

The lower side gripping member 44 is assembled with the body base 41 by screwing each male screw 44*g* to each female screw part 41*l* of the body base 41 from each inserting hole 44*b*.

The upper side gripping member 43 is configured with a ring member. In the upper side gripping member 43, a part of the member is placed between the body base 41 and the lower side gripping member 44, and the upper side gripping member 43 is configured to be able to move up and down in a predetermined range.

On the upper surface of the upper side gripping member 43, an edge wall 43*a* hanging along all of the inner periphery edge is formed. In the edge wall 43*a*, with respect to the place corresponding to each recessed part 44*c* of the lower side gripping member 44, a spring hook part 43*b* is formed. Further, in the outer periphery of the edge wall 43*a*, a guide groove 43*c* in the place corresponding to each guide projection 44*d* of the aforementioned lower side gripping member 44 is provided.

The outer periphery part of the upper side gripping member 43 is formed by a small blade 43*d* having various tip shapes. The lower surface of the small blade 43*d* is formed in an angular shape or a flat shape, and by the lower surface of the small blade 43*d*, the gripping part 43*e* configured with small protrusions and recesses is formed. The gripping part 43*e* is curved in a sine wave shape with respect to the horizontal plane as a whole. By the way, instead of being provided with only the protrusions and recesses, the gripping surface of the gripping part 43*e* may be formed by a rubber, which has a large friction resistance, with protrusions and recesses.

The upper side gripping member 43 is assembled with the body base 41 by matching the guide projections 44*d* with the guide grooves 43*c* and assembling the lower side gripping member 44 to the body base 41 in the state in which the upper side gripping member 43 is fitted to the lower side gripping member 44 from the upper side. At this point, springs 43*f* are interposed between the spring hook parts 41*m* of the body base 41 and the spring hook parts 43*b* of the upper side gripping member 43. Accordingly, the upper side gripping member 43 is urged to the lower side gripping member 44. By the way, without interposing the springs 43*f*, it is possible to urge toward the lower side gripping member 44 by the own weight of the upper side gripping member 43.

Figure 7:
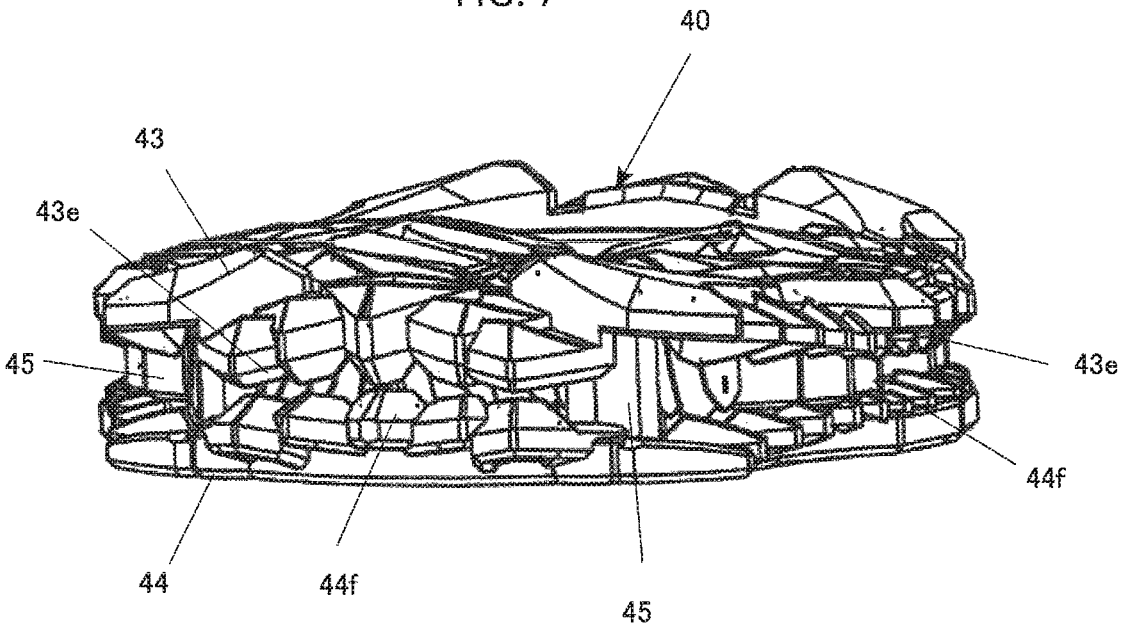
FIG. 7 is a diagram showing two gripping parts of the spinning top toy when viewed from one direction in a radial direction.
Figure 8:
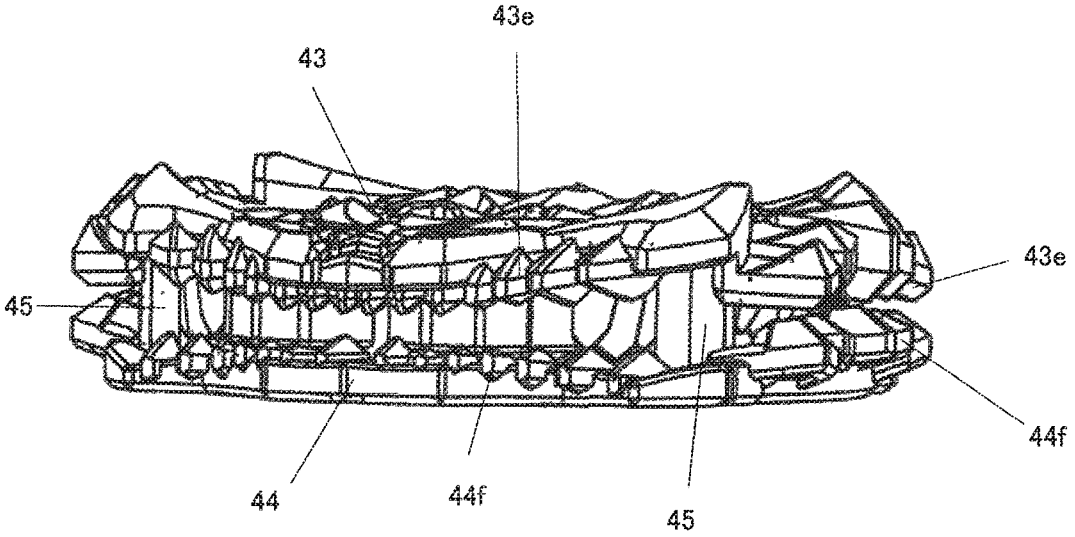
FIG. 8 is a diagram showing the two gripping parts of the spinning top toy when viewed from another direction in a radial direction.

FIG. 7 is a diagram showing the body 40 when viewed from one direction in a radial direction. FIG. 8 is a diagram showing the body 40 when viewed from another direction in a radial direction.

As shown in these drawings, a distance between the gripping part 43*e* of the upper side gripping member 43 and the gripping part 44*f* of the lower side gripping member 44 is set to be large or small in the circumferential direction. Here, the place where the distance between the gripping part 43*e* of the upper side gripping member 43 and the gripping part 44*f* of the lower side gripping member 44 becomes larger make up an introduction opening 45. The introduction opening 45 leads the outer periphery of the body of opponent's spinning top toy 1A to the place between the gripping part 43*e* of the upper side gripping member 43 and the gripping part 44*f* of the lower side gripping member 44 according to the rotation of the spinning top toy 1.

Assembly Method of Spinning Top Toy 1

Next, an assembly method of the spinning top toy 1 will be described. Here, it is assumed that the assembly of the body 40 has been already finished.

First, the shaft part 10 and the flywheel 30 are assembled in fitting state by matching the projection parts 16 of the shaft part 10 with the recessed parts 32 of the flywheel 30 from the lower side. Next, the assembled body is brought close to the body 40 from the lower side.

Figure 9:
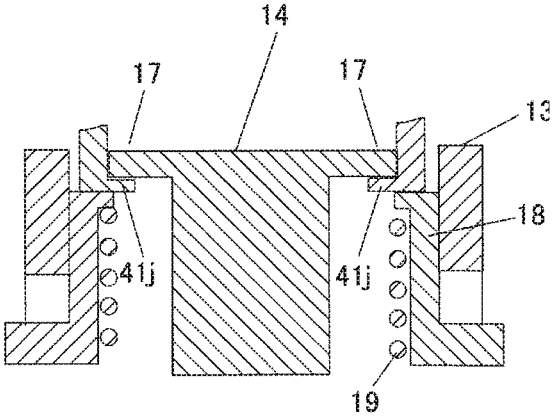
FIG. 9 is a partial cross-sectional view showing a connection configuration of the body and the shaft part of the spinning top toy.

Then, the tongue-piece parts 33 of the flywheel 30 are inserted into one end part of the arcuate slits 41 of the body 40 from the lower side. In this state, the hook 17 of the shaft part 10 is positioned between two of the hooks 41*j*. This state is the connection releasing state. After that, the shaft part 10 of the aforementioned assembled body is pressed to the body 40 side. Then, first, the flywheel 30 is pressed against the lower surface of the body 40. Further, the spring 19 inside the shaft part 10 is contracted and the urging member 18 is lowered, so that the hooks 17 of the shaft part 10 are relatively pushed more upward than the hooks 41*j* of the body 40. Then, the hooks 41*j* of the body 40 are placed in the lower side of the hooks 17 of the shaft part 10. When the shaft part 10 is integrally rotated with the flywheel 30 in the predetermined direction (direction opposite to the rotation direction of the spinning top toy 1), it becomes a state in which the hooks 17 and the hooks 41*j* are overlapped in the vertical direction. When hand leave the shaft part 10, by the urging force of the spring 19 inside the shaft part 10, as shown in FIG. 9, the lower surface of the hooks 17 of the shaft part 10 and the upper surface of the hooks 41*j* of the body 40 are contacted. In this state, that is, the state in which the lower surface of the hooks 17 of the shaft part 10 and the upper surface of the hooks 41*j* of the body 40 are in contact is the assembled state. Accordingly, the projections 20 are meshed with the raised parts 41*k*, so that the spinning top toy 1 is assembled.

How to Play, Etc.

Next, an example of how to play with the spinning top toy 1 will be described.

Figure 10:
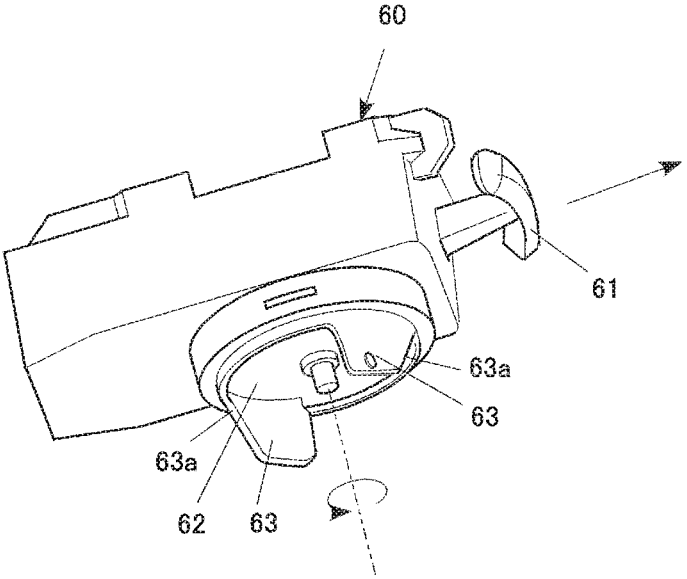
FIG. 10 is a perspective view of a launcher.

In this case, a charge of the spinning force of the spinning top toy 1 is performed by the launcher (launching device) 60 as shown in FIG. 10. In the inside part, the launcher 60 is provided with a disk which is not shown, and the disk is energized in one rotational direction by the power spring which is not shown. When the string, which is not shown, wound around the disk is pulled by a handle 61, the disk is rotated, and therefore, the spinning top holder 62 is rotated. The rotation of the spinning holder 62 is transmitted to the spinning top 1 by the forks 63 projecting downward, so that the spinning top toy 1 spines. In this case, the forks 63 are inserted to the arcuate slits 41*e* of the body part 40. When the handle 61 of the launcher 60 is pulled to the end, the rotation of the disk and further, the spinning top holder 62 is stopped, and on the other hand, the spinning top toy 1 is rotated further by the inertia force, so that the spinning top toy 1 is released from the spinning top holder 62 in accordance with the tilting faces 63*a* of the forks 63.

Figure 11:
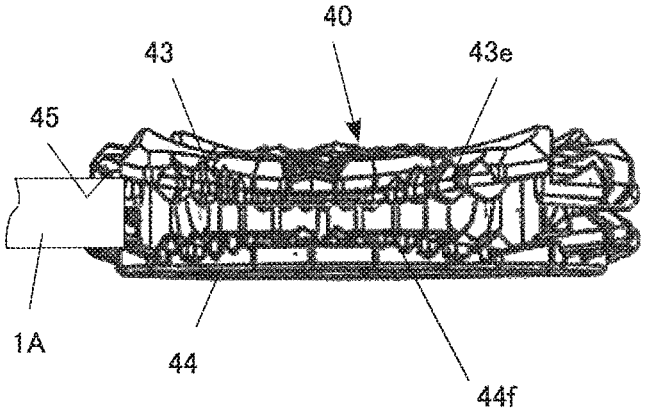
FIG. 11 is a diagram showing an initial state of the two gripping parts of the spinning top toy.
Figure 12:
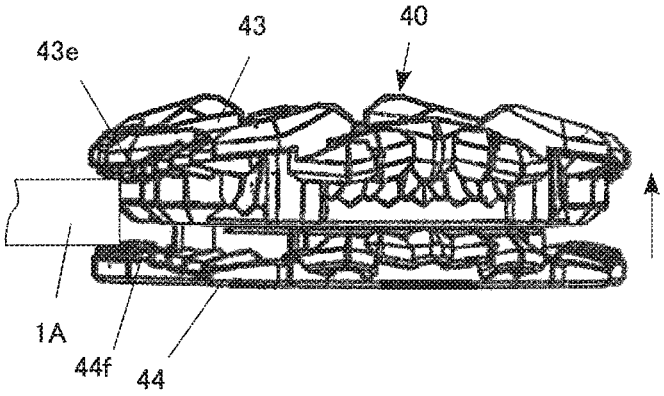
FIG. 12 is a diagram showing a gripping state of the two gripping parts of the spinning top toy.

The spinning top toy 1, which is launched in such manner, is rotated in a predetermined direction in a predetermined field, and when it collides with opponent's spinning top toy 1A, the body outer periphery of opponent's spinning top toy 1A enters into the introduction opening 45 (see FIG. 11). With this, the outer periphery of the body of opponent's spinning top toy 1A is lead to be between the gripping part 43*e* or the gripping part 44*f*, and the upper side gripping member 43 is raised against the urging force of the spring 43*f* (see FIGS. 1 and 2), so that it is temporary gripped by the gripping part 43*e* or the gripping part 44*f*, and the rotation of opponent's spinning top toy 1A is reduced. At this time, the rotation of own spinning top toy 1 is also reduced. Further, when the outer periphery of the body of opponent's spinning top toy 1A also contacts to the gripping part 43*e*, the upper side gripping member 43 is raised against the urging force of the spring 43*f* (see FIG. 12), so that it is temporary gripped by the gripping part 43*e* or the gripping part 44*f*, and the rotation of opponent's spinning top toy 1A is reduced.

On the other hand, by receiving the impact force due to the collision, the force in the direction opposite to the rotation direction of the shaft part 10 and the flywheel 30 is applied to the body 40 of own spinning top toy 1, so that the body 40 is relatively rotated in the direction opposite to the rotation direction of the shaft part 10 and the flywheel 30.

In accordance with the relative rotation of the shaft part 10 with respect to the body 40, the meshing position of the raised parts 41*k* of the lower surface of the body 40 and the protruding strips 20 is changed. When it reaches the locking releasing position, the locking of the hooks 41*j* of the body 40 and the hooks 17 of the shaft part 10 are released, so that the body 40 is separated from the shaft part 10 by the urging force of the spring 19 in the shaft part 10.

Modification Examples of the Embodiments

The embodiments of the present invention were described above, but the present invention is not limited to the aforementioned embodiments, and needless to say, various modifications may be made.

For example, in the aforementioned embodiments, the introduction opening 45 defined by the two gripping members 43, 44 is provided, but it is not limited to this, and it may be the one in which a slide contact part in any one of the gripping members may be projected. That is, in accordance with the rotation, by sliding with opponent's spinning top toy 1A, the outer periphery of the body of the spinning top toy 1A is lead to a place between the gripping parts 43*e*, 44*f* of the two gripping members 43, 44.

Further, in the aforementioned embodiments, the upper side gripping member 43 is urged toward the lower side gripping member 44, but it may be reversed such that the lower side gripping member 44 may be urged toward the upper side gripping member 43. Both of the upper side gripping member 43 and the lower side gripping member 44 may be urged in the direction mutually approaching each other.

Further, the upper side gripping member 43 and the lower side gripping member 44 may not be an annular shape, and it may be partially existing in the circumferential direction.

Effect of the Invention

When the spinning tops are rotated and collided to each other, the outer periphery of the body of opponent's spinning top toy is held by the upper and lower gripping parts, so that there is unexpectedness in the movement. Therefore, the rotation speed of opponent's spinning top toy and including the own spinning top toy can be significantly reduced, and the game development can be largely changed.

The gripping parts are formed along the outer periphery, so that in accordance with the rotation, the outer periphery of the body of opponent's spinning top toy can be held for a long time by the upper and lower gripping parts.

The two gripping members can be surely approached.

Since the introduction part is provided, it easily receives the outer periphery of the body of opponent's spinning top toy.

The protrusions and recesses are formed in the gripping parts, so that the braking effect can be further enhanced.

The gripping parts can be provided in a wide range of the outer periphery.

A distance between one gripping part in one of the two gripping members and the other one of the gripping parts is different in a circumferential direction, so that the gripping force can be changed in the circumferential direction. Therefore, it is possible to perform games having a variety of changes.

What is claimed is:

1. A spinning top toy used for battle games in which the spinning top toy collides with an opponent spinning top toy, comprising:

a shaft part;

a body configured on the shaft part;

first and second gripping members being configured on at least a part of an outer periphery of the body; and an urging part urging the first gripping member to the second gripping member, the first gripping member being movable in a direction in which the shaft part extends.

2. The spinning top toy according to claim 1, wherein the first gripping member includes gripping parts formed along the outer periphery of the body.

3. The spinning top toy according to claim 1, further comprising an urging part urging at least the one of the first and second gripping members towards the other of the first and second gripping members.

4. The spinning top toy according to claim 1, wherein the body includes an introduction part being configured to lead an outer periphery of the opponent spinning top toy into a space between the first and second gripping members.

5. The spinning top toy according to claim 1, wherein the first gripping part includes protrusions and recesses.

6. The spinning top toy according to claim 1, wherein the first gripping member includes an annular component which surrounds the shaft center.

7. The spinning top toy according to claim 1, wherein the first gripping member is formed wavy in a circumferential direction.

8. The spinning top toy according to claim 1, wherein the first and second gripping members are arranged to grip the opponent spinning top toy therebetween.

9. The spinning top toy according to claim 1, wherein the urging part is a spring.

* * * * *